United States Patent [19]

Sassen

[11] Patent Number: 4,618,046

[45] Date of Patent: Oct. 21, 1986

[54] SHIFTING COUPLING

[75] Inventor: Heinrich Sassen, Rosengarten, Fed. Rep. of Germany

[73] Assignee: Zahnradfabrik Altona-Elbe Hans Meyer GmbH & Co. KG, Hamburg, Fed. Rep. of Germany

[21] Appl. No.: 696,359

[22] Filed: Jan. 30, 1985

[30] Foreign Application Priority Data

Feb. 13, 1984 [DE] Fed. Rep. of Germany ..... 3405038

[51] Int. Cl.[4] ..... F16D 11/00; F16D 23/14

[52] U.S. Cl. ..... 192/67 P; 192/67 R; 192/95; 192/108

[58] Field of Search ..... 192/67 R, 67 P, 93 A, 192/95, 108, 56 R

[56] References Cited

U.S. PATENT DOCUMENTS 2,846,859 8/1958 Schröter et al. ..... 192/67 R
3,979,925 9/1976 Kato ..... 192/56 R

FOREIGN PATENT DOCUMENTS 1178262 9/1964 Fed. Rep. of Germany .... 192/67 R

*Primary Examiner*—Rodney H. Bonck
*Assistant Examiner*—David A. Testardi
*Attorney, Agent, or Firm*—Becker & Becker

[57] ABSTRACT

A shifting coupling which is preferably provided for the travel mechanisms of overhead conveyors, and which operates in a positively engaging manner counter to a spring which acts in the disengagement direction. The coupling projections or engaging members, which are provided on a coupling flange, are controlled with the aid of two sleeves which are movable relative to one another. Those ends of the sleeves which butt against one another are provided with oppositely extending conical surfaces. Control balls can be pressed into the wedge-shaped recess which results between the two conical surfaces. The control balls press the two sleeves apart in order to engage the coupling. A control sleeve, which is provided with inner conical and annular surfaces, serves for the radial movement of the control balls. During the engagement process, the control sleeve is resiliently prestressed in such a direction that the conical surface thereof contacts the control balls in the direction of coupling engagement. The actual engagement process is not triggered until the positively engaging, intermeshing coupling members are aligned with one another, and the two sleeves are driven apart by the control balls, to the extent that a spring tension acts thereupon.

7 Claims, 2 Drawing Figures

SHIFTING COUPLING

Background of the Invention

1. Field of The Invention

The present invention relates to a positive-engagement shifting coupling, especially for the reduction gearing of overhead conveyor travel mechanisms which are driven by electric motors.

With regard to the aforementioned preferred application, the gear units for the travel mechanisms of overhead conveyors, which gear units are united with electric motors, must generally be capable of being disengaged, on the one hand in order to be able to manually move the overhead conveyors, and on the other hand in order to be able to automatically disconnect the travel mechanism if during operation on the track a problem occurs which requires immediate stopping or singling out of individual overhead conveyors.

2. Description of the Prior Art

The heretofore known couplings, which are provided with friction linings, intermediate shafts which can be swung away, etc., are extremely complicated, expensive, and also require maintenance.

An object of the present invention to provide an improved shifting coupling which is distinguished by a particularly economical and sturdy mechanical design, which can be operated for long periods of time without maintenance and which is also economical.

BRIEF DESCRIPTION OF THE DRAWINGS

This object, and other objects and advantages of the present invention, will appear more clearly from the following specification in conjunction with one exemplary embodiment of a gear unit which is suitable for overhead conveyors, in which.

SUMMARY OF THE INVENTION

Figure 1:
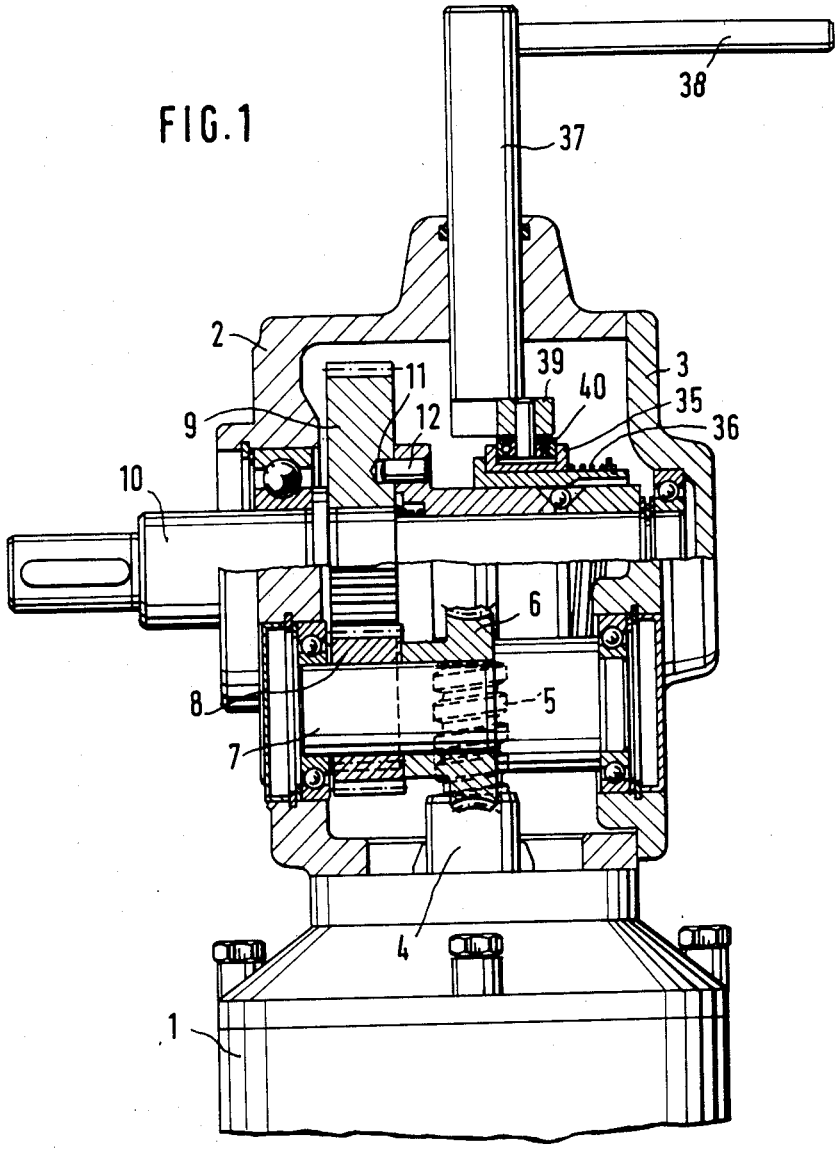
FIG. 1 is a partially broken away and partially axially sectioned view of a gear unit for an overhead conveyor.

The shifting coupling of the present invention is characterized primarily in that the output gear wheel of the gear unit is freely rotatably mounted on the output shaft, and is provided with at least one essentially axially parallel disposed recess directed for receiving in engagement therewith at least one essentially axially parallel disposed coupling projection of a coupling flange which is mounted on the output shaft in such a way as to be axially displaceable yet nonrotatable relative thereto, and which is adapted to be held in the disengagement position by means of a compression spring; in that the coupling flange is connected to a cylindrical thrust or sliding sleeve which slides on the output shaft and against which can butt a counter retaining sleeve which is connected to the output shaft in such a way that it is not axially displaceable relative thereto; in that the sleeve ends which face one another are provided with conical surfaces which diverge outwardly in opposite directions and between which are disposed control balls having a diameter of a magnitude such that in the engaged state, when the sleeves are moved as far apart as possible, the balls do not extend beyond the outer diameter of the sleeves, yet in the disengaged state, when the sleeves butt against one another, the balls extend radially beyond the outer diameter of the sleeves; in that the two sleeves are encircled by a shift or control sleeve which is mounted on the sliding sleeve in such a way as to be axially displaceable relative thereto, and which in the region of the abutting sleeve ends has an inner diameter which is enlarged by an amount corresponding to the amount of radical movement of the control balls, with a conical surface which bridges the differences in diameter of the control sleeve being adapted to contact the control balls; and in that a control ring is disposed on the control sleeve in such a way that it can be axially displaced within certain limits; the control ring, by means of a shifting mechanism, and against a spring which acts in the disengagement direction, can prestress the control sleeve and hence the control balls, the sliding sleeve, and the coupling flange in the coupling or engagement direction.

Pursuant to further specific features of the present invention, an eccentric extension of a shifting shaft can engage in the control ring; the eccentric extension is provided with a thrust bearing, is mounted at right angles to the output shaft in the gear unit housing, and supports a radial actuation handle outside the housing. The compression spring, the sliding sleeve, the control balls, and the counter retaining sleeve may be disposed between two snap rings in the output shaft in such a way that they are axially movable to limited extent. The spring which acts upon the control ring in the disengagement direction may be stronger than the compression spring which acts upon the coupling flange in the disengagement direction. The half cone apex angle of the conical surfaces of the sliding sleeve and counter retaining sleeve which act upon the control balls may be approximately 45°. The coupling projections of the coupling flange may be cylindrical studs or pins. The axial location of the conical surface which is disposed between the larger and smaller inner diameters of the cylindrical surfaces of the control sleeve may be such that in the coupled or engaged state, the conical surface no longer contacts the control balls, and a self-locking occurs.

The present invention is suitable not only for the aforementioned reduction gearing of overhead conveyor travel mechanisms driven by electrical motors; rather, it can be used at any time that two elements which are to be coupled have speeds which during the coupling process do not differ much from one another.

DESCRIPTION OF THE PREFERRED EMBODIMENTS

Figure 2:
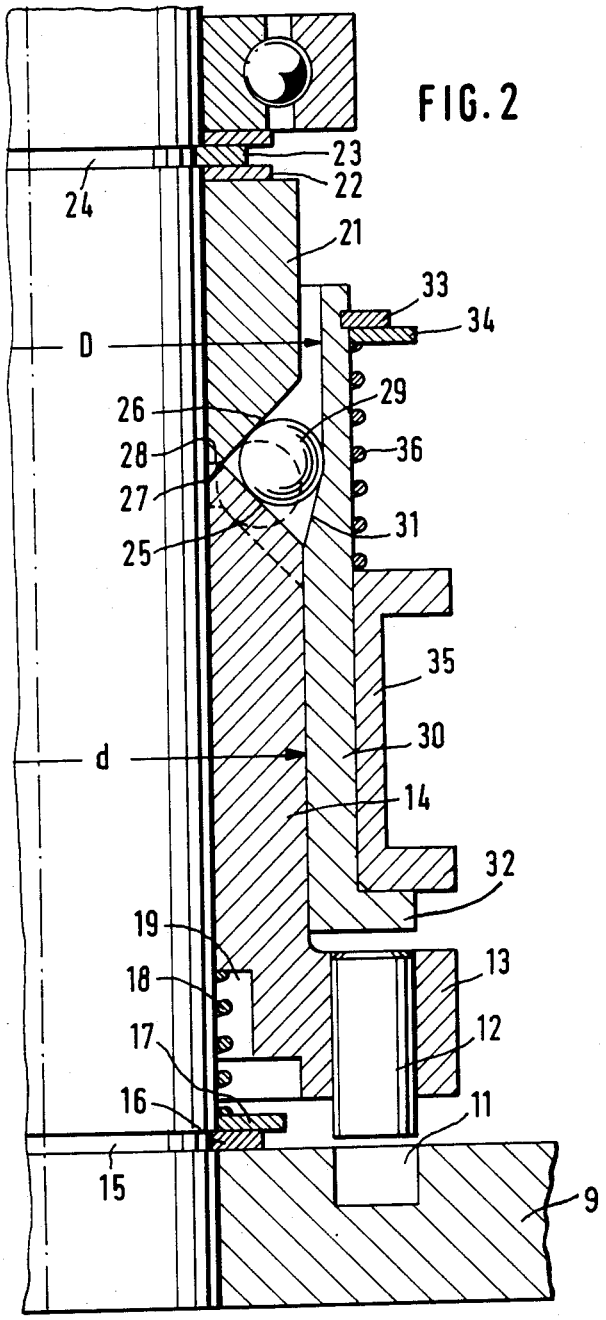
FIG. 2 is an enlarged partial axial section through the output shaft of the gearing of FIG. 1.

Referring now to the drawings in detail, the inventive shifting coupling, which operates in a positively engaging manner, and is part of a gearing for overhead conveyors, is illustrated in the coupled or engaged state in FIG. 1, and in the uncoupled or disengaged state in FIG. 2.

The gearing, which is flange-mounted on a partially illustrated electric motor 1, comprises a housing 2 which is closed-off by a cover 3. The drive shaft 4 which comes from the electric motor 1 supports a worm 5 which meshes with a worm gear 6. The worm gear 6 is supported by a shaft 5 which is mounted in the gear unit housing 2 transverse to the axis or drive shaft 4 of the electric motor 1. The shaft 7 also supports a pinion 8 which meshes with a large spur gear 9, which will subsequently be referred to as the output gear wheel of the gearing or gear unit.

The output gear wheel 9 of the gear unit is rotatably disposed on an output shaft 10 of the gearing. The shaft 10 is mounted in the housing 2 in the same way as is the shaft 7. A wheel of the travel mechanism of the overhead conveyor can be placed upon the end of the output shaft 10. The inventive, positively engaging, shifting coupling is disposed between the aforementioned output gear wheel 9 and the output shaft 10, as will be subsequently described in detail with the aid of FIG. 2.

The output gear wheel 9 is provided with one or more axially parallel disposed coupling recesses 11 which serve for receiving in engagement therewith essentially axially parallel disposed coupling projections 12, one or more thereof being disposed an equal distance from the axis of rotation respectively. In the illustrated embodiment, the coupling recesses 11 are cylindrical bores, and the coupling projections 12 are cylindrical studs or pins. Other coupling elements could similarly be used. It is also conceivable, to facilitate entry of the coupling projections into the coupling recesses, to provide helically extending channels on the output gear wheel 9 which have their maximum depth in the coupling recess itself. The coupling projection 12, which is in the form of a pin, is fixedly disposed in a coupling flange 13 which is integrally connected with a cylindrical thrust or sliding sleeve 14. The sleeve 14 is supported by the output shaft 10 in an axially displaceable yet non-rotatable (not illustrated) manner relative thereto. A snap ring 16, which is disposed in a annular groove 15 of the output shaft 10, determines the axial position of the freely rotatable output gear wheel 9, and also serves as a stop for an annular spring abutment 17, against which is supported a compression spring 18 with which the sliding sleeve 14 is pressed into the disengaged position illustrated in FIG. 2. That end of the compression spring 18 remote from the abutment 17 is supported at the base of an axial recess 19 of the sliding sleeve 14. The recess 19 assures that in the coupled or engaged state (FIG. 1), the end face of the coupling flange 13 can rest directly against the facing side surface of the output gear wheel 9.

Located directly next to the sliding sleeve 14 on the output shaft 10 is a counter retaining sleeve 21 which has the same inner diameter as does the sleeve 14, and can also have the same outer diameter. The counter retaining sleeve 21 is supported via an annular member 22 against a further snap ring 23, which is placed in a further annular groove 24 of the output shaft 10. Those end faces of the sleeves 14 and 21 which face one another are in the form of conical surfaces 25 and 26, which extend in opposite directions and diverge outwardly. So that the sleeves 14 and 21 do not butt against one another along a line, the conical surfaces 25 and 26 preferably do not extend all the way to the inner periphery of the sleeves 14 and 21; instead, annular disk-like abutment surfaces 27 and 28 adjoin the conical surfaces 25 and 26. The half cone apex angle of each of the conical surfaces 25 and 26 is preferably approximately 45°, so that the conical surfaces 25 and 26 extend approximately at right angles to one another. Three or more shift or control balls 29 are disposed between the conical surfaces 25 and 26. The diameter of the balls 29 is such that when the sleeves 14 and 21 rest against one another, as shown in FIG. 2, the balls 29 extend beyond the outer diameter of the sleeves 14 and 21. In contrast thereto, if the sleeves 14 and 21 are pulled apart, accompanied by compression of the spring 18, as shown in dashed lines in FIG. 2, the control balls 29 can assume a position in which their outer surfaces are flush with the outer diameters of the sleeves 14 and 21. Obviously, in order to provide coupling or engagement, it is necessary to bring the control balls 29 from the position illustrated in FIG. 2 into the position shown in dashed lines in FIG. 2 and in solid lines in FIG. 1.

A shift or control sleeve 30 is provided for moving the control balls 29. Over a larger portion of its length, the control sleeve 30 has an inner diameter "d" which coincides with the outer diameter of the sliding sleeve 14. However, that end of the sleeve 30 remote from the coupling flange 13 is provided with a larger diameter "D". Where the control sleeve 30 has the larger diameter "D", it surrounds the counter retaining sleeve 21 with play. The diameter "D" is such that the control balls 29 can assume the disengagement position illustrated in FIG. 2. Between the portion with the larger diameter "D" and the portion with the smaller diameter "d", the inner surface of the control sleeve 30 is in the form of the conical surface 31. This conical surface 31 makes it possible to press the control balls 29 inwardly and to drive the two sleeves 14 and 21 apart, so that the coupling projections 12 can engage in the coupling recesses 11. This is, of course, only possible when the coupling elements 11 and 12 are aligned with one another.

A shift or control ring 35 is disposed on the outer periphery of the control sleeve 30 between an integrally formed annular flange 32 and an abutment 34 which is held by a snap ring 33. With the aid of the compression spring 36 which is disposed between the control ring 35 and the abutment 34, the ring 35 is prestressed in the disengagement direction.

If, proceeding from FIG. 2, the positively engaging coupling is now to be provided, the shifting shaft 37, which is illustrated in FIG. 1 and is mounted in the gear unit housing 2, is rotated with a radial handle 38 or the like. Within the housing 2, the shifting shaft 37 supports an eccentric 39 having a thrust bearing 40 which extends into the U-shaped circumferential profile of the control ring 35. When the shifting shaft 37 is turned in such a way that pursuant to FIG. 2 the control ring 35 is moved toward the top of the page, the compression spring 36 is contracted. This tensioned state of the compression spring 36 is maintained until the coupling process is terminated. To begin with, a radially inwardly directed stress is exerted by the control sleeve 30 upon the control balls 29 due to the force of the spring 36; the balls 29 then strive to drive the two sleeves 14 and 21 apart. This last-mentioned movement is possible at the moment in which the coupling pins 12 can engage the coupling bores 11. Thus, during the connection or engagement process, the spring 36, while it is being tensioned, takes care of shifting the control sleeve 30 upwardly in FIG. 2 on the sliding sleeve 14. As this occurs, the conical surface 31 of the sleeve 30 presses against the control balls 29, which then move into the position illustrated in dashed lines in FIG. 2, whereby they drive the two sleeves 14 and 21 apart to such an extent that the outer end face of the coupling flange 13 is pressed against the oppositely disposed end face ot the output gear wheel 9, resulting in a coupling engagement between the pins 12 and the recesses 11.

When during a disengagement process the shifting shaft 37 is moved in the opposite direction, the control sleeve 30 is displaced in the direction toward the coupling flange 13, so that the control balls 29 are no longer stressed by that section of the sleeve 30 which has the smaller diameter "d". In conformity with the illustration of FIG. 2, the shift balls can then move outwardly, so that the compression spring 18 can again move the two sleeves 14 and 21 together, resulting in a release of the coupling. From the previous description, it should be clear that the compression spring 36 which acts upon the control ring 35 should preferably be stronger than the spring 18 which pushes the coupling flange 13 away from the output gear wheel 9.

The present invention is, of course, in no way restricted to the specific disclosure of the specification and drawings, but also encompasses any modifications within the scope of the appended claims.

What I claim is:

1. A positive-engagement shifting coupling, comprising:

an output shaft;

an output gear wheel, which is freely rotatably mounted on said output shaft and has at least one essentially axially parallel disposed recess;

a cylindrical sliding sleeve, which is mounted on said output shaft in such a way that it is non-rotatable relative thereto, yet can shift position on said output shaft in the axial direction thereof;

a compression spring for urging said sliding sleeve into a disengagement position of said coupling;

a coupling flange which is connected to said sliding sleeve, said coupling flange being provided with at least one essentially axially parallel disposed coupling projection which is adapted to be received in mating engagement with said at least one recess of said output gear wheel to effect said positive engagement when said coupling is in an engagement position;

a counter retaining sleeve, which is mounted on said output shaft in such a way that it is not axially displaceable relative thereto; each of said sliding sleeve and said retaining sleeve has an end which faces the other, and which are adapted in part to butt against one another when said coupling is in said disengagement position; said facing ends of said sleeves are also provided with respective conical surfaces which diverge outwardly, i.e. away from said output shaft, in opposite directions;

control balls, which are disposed between said conical surfaces of said sliding sleeve and said retaining sleeve, and which have a diameter of a magnitude such that in said engagement position of said coupling, with said sliding sleeve shifted as far as possible from said retaining sleeve, said control balls do not extend radially beyond the outer diameter of said sleeves, yet such that in said disengagement position of said coupling, with said sliding sleeve butting against said retaining sleeve, said control balls do extend radially beyond the outer diameter of said sleeves;

a control sleeve, which is mounted on said sliding sleeve in such a way as to be axially displaceable relative thereto, and which encircles both said sliding sleeve and said retaining sleeve; that portion of said control sleeve which is closer to said coupling flange of said sliding sleeves has a first inner diameter, and that portion of said control sleeve which is remote from said coupling flange has a second inner distance which is greater than said first inner diameter by an amount corresponding to the radial movement of said control balls between said engagement and disengagement positions; a conical transition surface, which is adapted to contact said control balls, is provided between said portion of said control sleeve with said first inner diameter, and said portion of said control sleeve with said second inner diameter;

a control ring, which is disposed on said control sleeve in such a way that it can be axially displaced within certain limits;

a second spring for urging said control ring into said disengagement position; and a shifting mechanism for displacing said control ring against the force of said second spring for prestressing said control sleeve, and hence said control balls and said sliding sleeve with its coupling flange, in the engagement direction.

2. A shifting coupling according to claim 1, which includes a gear unit housing in which said output shaft is mounted; which also includes a shifting shaft which is mounted in said housing at right angles to said output shaft, and has a radial actuation handle outside of said housing; and in which said shifting mechanism for displacing said control ring includes an eccentric extension which is connected to said shifting shaft; said eccentric extension is provided with a thrust bearing which engages said control ring.

3. A shifting coupling according to claim 2, in which said output shaft is provided with two snap rings which are fixed in position thereon; the axial movement of said compression spring, said sliding sleeve, said control balls, and said counter retaining sleeve is delimited by and between said snap rings.

4. A shifting coupling according to claim 3, in which said second spring, which urges said control ring into said disengagement position, is stronger than said compression spring, which urges said sliding sleeve with its coupling flange into said disengagement position.

5. A shifting coupling according to claim 3, in which the half cone apex angle of said conical surfaces, between which said control balls are disposed, is approximately 45°.

6. A shifting coupling according to claim 5, in which said coupling projections of said coupling flange are cylindrical pins.

7. A shifting coupling according to claim 6, in which the axial location of said conical transition surface of said control sleeve is such that in the engagement position of said coupling, said transition surface no longer contacts said control balls, and a self-locking occurs.

* * * * *